US008181573B2

(12) United States Patent
Greive et al.

(10) Patent No.: US 8,181,573 B2
(45) Date of Patent: May 22, 2012

(54) METHOD AND APPARATUS FOR FEEDING PRINTING PLATES TO A PLATE CYLINDER OF A PROCESSING MACHINE

(75) Inventors: Martin Greive, Schriesheim (DE); Rolf Hilpert, St. Leon-Rot (DE); Alexander Knabe, Heidelberg (DE); Rainer Schmitt, Heidelberg (DE)

(73) Assignee: Heidleberger Druckmaschinen Aktiengesellschaft, Heidelberg (DE)

( * ) Notice: Subject to any disclaimer, the term of this patent is extended or adjusted under 35 U.S.C. 154(b) by 545 days.

(21) Appl. No.: 12/412,877

(22) Filed: Mar. 27, 2009

(65) Prior Publication Data

US 2009/0241792 A1 Oct. 1, 2009

(30) Foreign Application Priority Data

Mar. 27, 2008 (DE) ..... 10 2008 016 225

(51) Int. Cl.
*B41F 27/12* (2006.01)

(52) U.S. Cl. .. 101/477; 101/481; 101/486; 101/DIG. 36

(58) Field of Classification Search ..... 101/477, 101/481, 485, DIG. 36
See application file for complete search history.

(56) References Cited

U.S. PATENT DOCUMENTS

| | | | | |
|---|---|---|---|---|
| 5,634,406 | A | 6/1997 | Lindner et al. | |
| 6,571,708 | B1 | 6/2003 | Rudzewitz et al. | |
| 2003/0056671 | A1 * | 3/2003 | Hashiguchi | 101/477 |
| 2004/0020386 | A1 * | 2/2004 | Koyanagi et al. | 101/415.1 |
| 2010/0101440 | A1 * | 4/2010 | Funk et al. | 101/486 |

FOREIGN PATENT DOCUMENTS

| | | | |
|---|---|---|---|
| DE | 94 18 049 | U1 | 12/1994 |
| DE | 44 39 623 | A1 | 5/1996 |
| DE | 198 03 723 | A1 | 8/1999 |
| DE | 100 01 320 | A1 | 7/2001 |
| DE | 10 2006 020 713 | A1 | 12/2006 |
| JP | 7241979 | A | 9/1995 |

* cited by examiner

*Primary Examiner* — Leslie J Evanisko
(74) *Attorney, Agent, or Firm* — Laurence A. Greenberg; Wener H. Stemer; Ralph E. Locher

(57) ABSTRACT

In an apparatus for feeding printing plates to a plate cylinder of a printing press, the printing plate is prealigned on stops outside the plate cylinder with a lateral offset and with an oblique skew. Then the printing plate is fed, in the thusly aligned position to the register pins of the plate cylinder, wherein the printing plate is finally aligned by lateral displacement and by a pivoting movement about the first register pin, until the printing plate bears with its receptacles against both register pins.

11 Claims, 4 Drawing Sheets

METHOD AND APPARATUS FOR FEEDING PRINTING PLATES TO A PLATE CYLINDER OF A PROCESSING MACHINE

CROSS-REFERENCE TO RELATED APPLICATION

This application claims the priority, under 35 U.S.C. §119, of German patent application DE 10 2008 016 225.6, filed Mar. 27, 2008; the prior application is herewith incorporated by reference in its entirety.

BACKGROUND OF THE INVENTION

Field of the Invention

The invention relates to a method and apparatus for feeding printing plates to a plate cylinder of a processing machine, in particular a printing press, having aligning means for the prealignment and final alignment of the printing plates.

An apparatus of this generic type is described in the commonly assigned German published patent application No. DE 198 03 723 A1 and its counterpart U.S. Pat. No. 6,571,708 B1. There, there is disclosed an apparatus for feeding printing plates to a plate cylinder of a printing press, having aligning means for the prealignment and final alignment of the printing plate. The aligning means for the prealignment have an offset as viewed in the printing plate feed direction. The offset is identical to an offset of the aligning means on the plate cylinder. This measure is intended to avoid the printing plate being fed with the sides reversed.

SUMMARY OF THE INVENTION

It is accordingly an object of the invention to provide a printing plate feed method and a printing plate feed apparatus, which overcome certain disadvantages of the heretofore-known devices and methods of this general type and which use aligning means that ensure tautening of the printing plate.

With the foregoing and other objects in view there is provided, in accordance with the invention, a method for feeding a printing plate to a plate cylinder of a processing machine, such as a printing press. The method comprises the following steps:

prealigning the printing plate on stops outside the plate cylinder in an obliquely and laterally offset position relative to a final alignment position;

subsequently feeding the printing plate to register devices of the plate cylinder with an oblique orientation and with a lateral offset; and aligning the printing plate laterally upon coming into contact with a first register device and pivoting the printing plate about the first register device until the printing plate is aligned in the final alignment position.

It is a particular advantage of the invention that the printing plate can be tautened simply by a fixed arrangement of the aligning means.

In accordance with an added feature of the invention, the printing plate is first brought into engagement with the first aligning device and subsequently into contact with a second aligning device by pivoting the printing plate about the first aligning device.

With the above and other objects in view there is provided, in accordance with the invention, an apparatus for feeding a printing plate to a plate cylinder of a processing machine, such as a printing press. The apparatus comprises:

an aligning assembly formed with an aligning device for a prealignment of the printing plate and an aligning device for a final alignment of the printing plate;

the aligning device for the prealignment of the printing plate having a lateral offset with respect to the aligning device for the final alignment of the printing plate on the plate cylinder;

the aligning device for the prealignment of the printing plate having a first stop and a second stop and the aligning device for the final alignment of the printing plate having a first register pin and a second register pin; and wherein a spacing between the first stop and the first register pin is greater than a spacing between the second stop and the second register pin.

In accordance with an added feature of the invention, there are provided transport means for transporting the printing plate from the first and second stops to the first and second register pins.

In accordance with an added feature of the invention, the stops for the prealignment of the printing plate are disposed on a protective device of the processing machine, such as on a cover of a cylinder and roll region of the printing press.

In accordance with an added feature of the invention, the first and second register pins (i.e., the final alignment register pins) are disposed on the plate cylinder.

The invention is particularly suited for implementation in the context of a rotary printing press.

Other features which are considered as characteristic for the invention are set forth in the appended claims.

Although the invention is illustrated and described herein as embodied in a method and apparatus for feeding printing plates to a plate cylinder of a processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
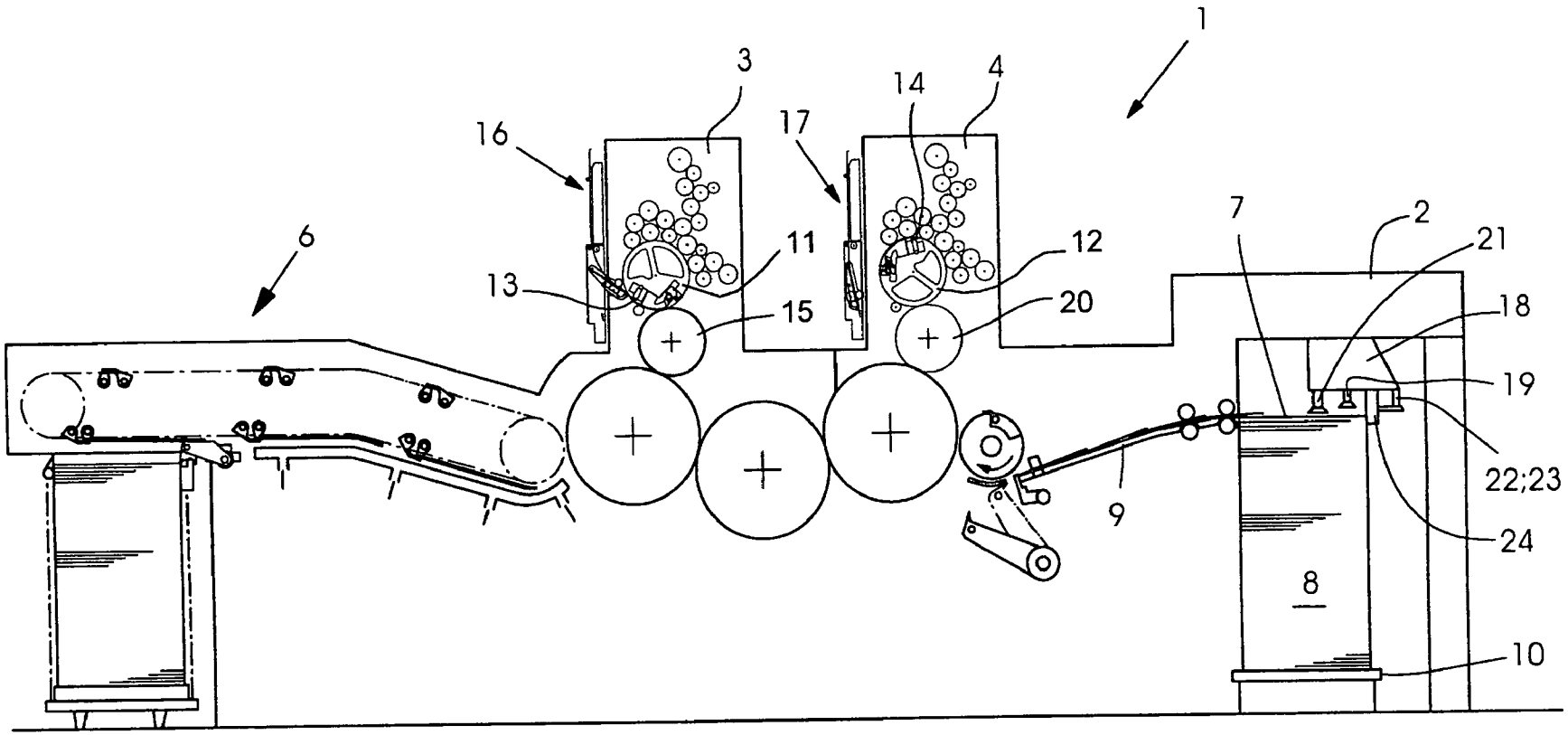
FIG. 1 is a diagrammatic sectional illustration of a sheet-fed rotary printing press.
Figure 2:
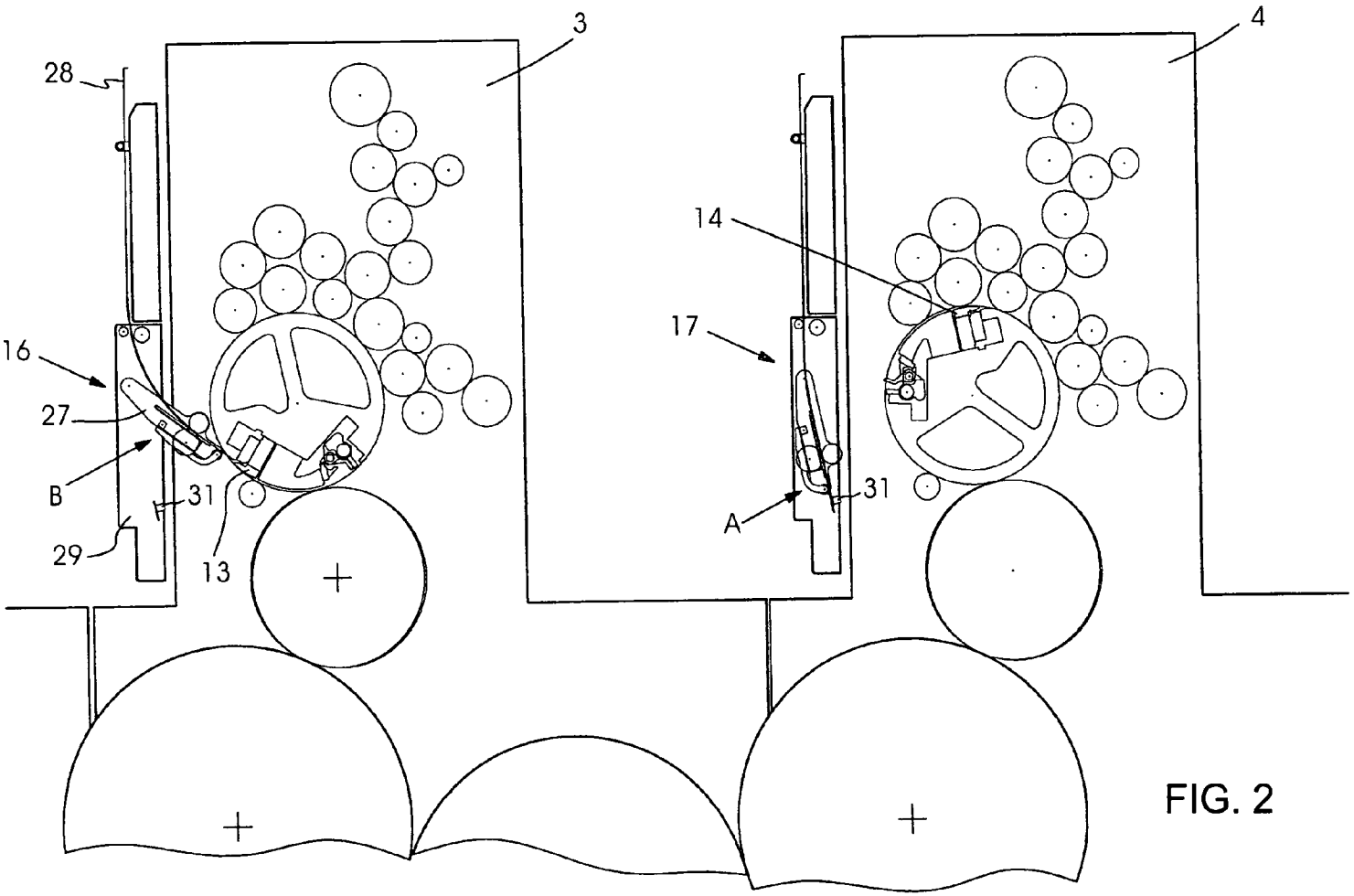
FIG. 2 shows the printing plate feed apparatus in an operating position and in a printing plate receiving position.
Figure 3:
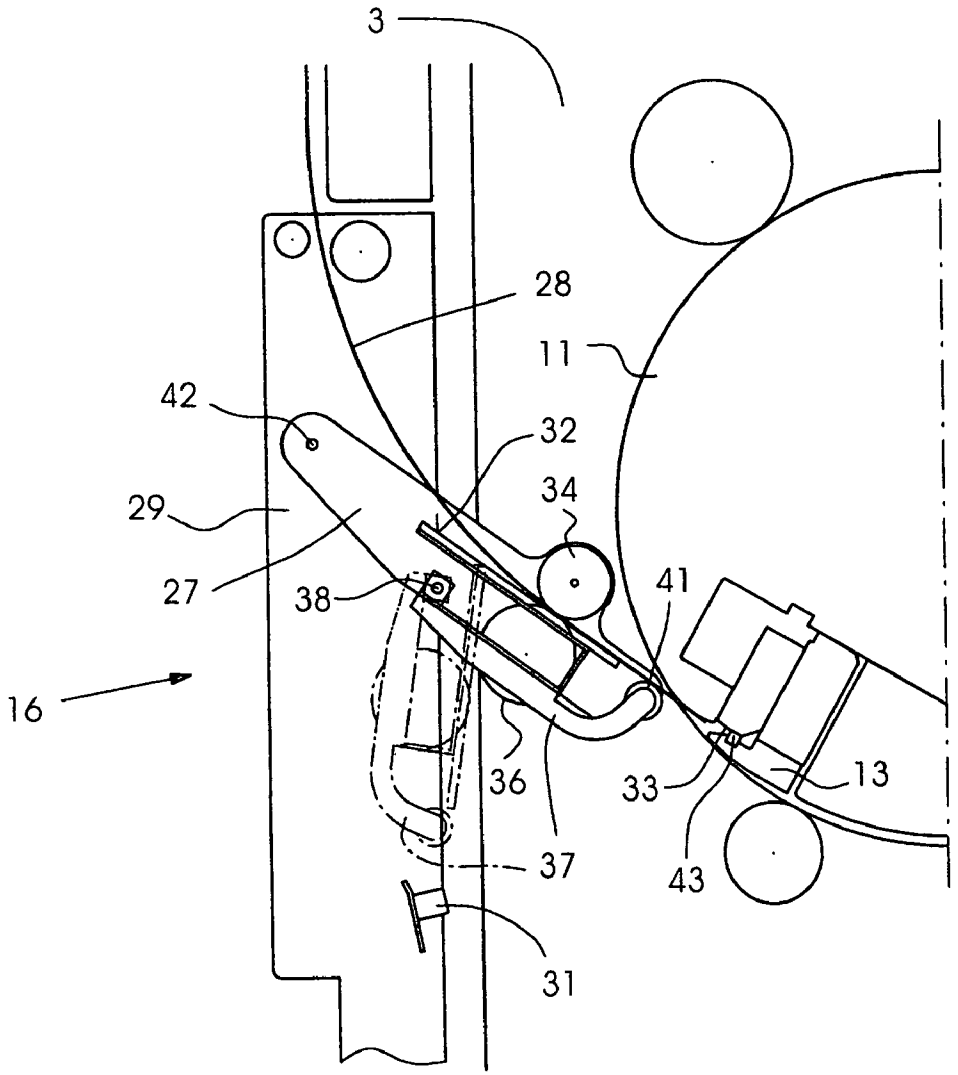
FIG. 3 shows the printing plate feed device in the operating position.

Referring now to the figures of the drawing in detail and first, particularly, to FIG. 1 thereof, there is shown a sheet-processing machine, for example a printing press 1. The assembly includes a feeder 2, at least one printing unit 3 and/or 4 and a delivery 6. Sheets 7 are removed from a sheet stack 8 and are fed in a separated or overlapping manner to the printing units 3 and 4 via a feed table 9. The printing units 3 and 4 comprise in a known manner in each case one plate cylinder 11, 12 and blanket cylinders 15, 20 which interact in each case with the latter. The plate cylinders 11 and 12 have in each case one clamping apparatus 13, 14 for fastening flexible printing plates. Moreover, each plate cylinder 11, 12 is assigned an apparatus 16, 17 for changing printing plates in a semiautomatic or fully automatic manner.

The sheet stack 8 rests on a stack board 10 which can be raised in a controlled manner. The sheets 7 are removed from the upper side of the sheet stack 8 by means of a so-called suction head 18 which has, inter alia, a number of lifting and dragging suckers 19, 21 for separating the sheets 7. Moreover, blowing devices 22 are provided for loosening the upper sheet layers and sensing elements 23 are provided for tracking the stack. A number of lateral and rear stops 24 are provided for aligning the sheet stack 8, in particular the upper sheets 7 of the sheet stack 8.

The apparatuses 16, 17 are structurally identical and will therefore be described using primarily by reference to the apparatus 16. The apparatus 16 has a guide element 27 for a printing plate 28. The guide element 27 is arranged pivotably on a protective means 29 which covers the cylinder and roll region in front of the printing unit 3. The guide element 27 is arranged such that it can be pivoted from a receiving position "A" for the printing plate 28, in which it is prealigned by means of provided stops 30, 31, into an operating position "B" for feeding the printing plate 28 to the plate cylinder 11. The guide element 27 has a guide plane 32 which, in the operating position "B", forms an extension of a printing plate clamping pad 33 of the clamping device 13 of the plate cylinder 11 and is arranged on the guide element 27 such that it can be pivoted on a lever 37. Furthermore, two transport rollers 34, 36 are arranged on the guide element 27, which transport rollers 34, 36 are jointly in working contact, in order to transport the printing plate 28 or to fix it in the receiving position "A". Here, the transport roll 34 which is in contact with the rear side of the printing plate 28 is arranged directly on the guide element 27, and the transport roll 36 which is in contact with the imaged printing plate front edge is mounted on the pivotably arranged lever 37. A printing plate flexing roller 41 is mounted rotatably at one end which is remote from the bearing point 38 of the lever 37. In the operating position "B", the printing plate flexing roller 41 lies between one end of the guide face 32 and the printing plate clamping pad 33. Here, the printing plate flexing roller 41 presses onto a defined location on the printing plate 28. The defined location corresponds to the bent location which a used printing plate has when it is reused. This bent location is produced by the transition from the clamping device 13 to the circumference of the plate cylinder 11.

In order to feed a new printing plate 28 or one which has already been used to the plate cylinder 11, the printing plate 28 is first of all prealigned on the stops 30, 31 in the receiving position "A". The guide element 27 then pivots about its bearing point 42 into the operating position "B" for feeding the printing plate. Here, the printing plate flexing roller 41 optionally presses onto the bent location of the used printing plate 28. The printing plate flexing roller 41 is then pivoted in the direction of the plate cylinder 11 until the printing plate front edge is aligned parallel to the printing plate clamping pad 33. As soon as the printing plate front edge is parallel to the clamping pad 33, the transport rolls 34, 36 transport the printing plate 28 into the clamping device 13.

The printing plate is prealigned on the stops 30, 31 in such a way that the printing plate is positioned obliquely in relation to its front edge by a small angular offset a and is prealigned by a lateral offset S with respect to the register pins 43, 44, also referred to as a first register device 43 and a second register device 44. The printing plate 28 is then fed to the register pins 43, 44 obliquely and with the lateral offset S.

A spacing a between the stop 30 for the prealignment of the printing plate 28 and the register pin 43 of the plate cylinder 11 is smaller than a spacing b between the stop 31 for the prealignment of the printing plate 28 and the register pin 44 of the plate cylinder 11.

Figure 4:
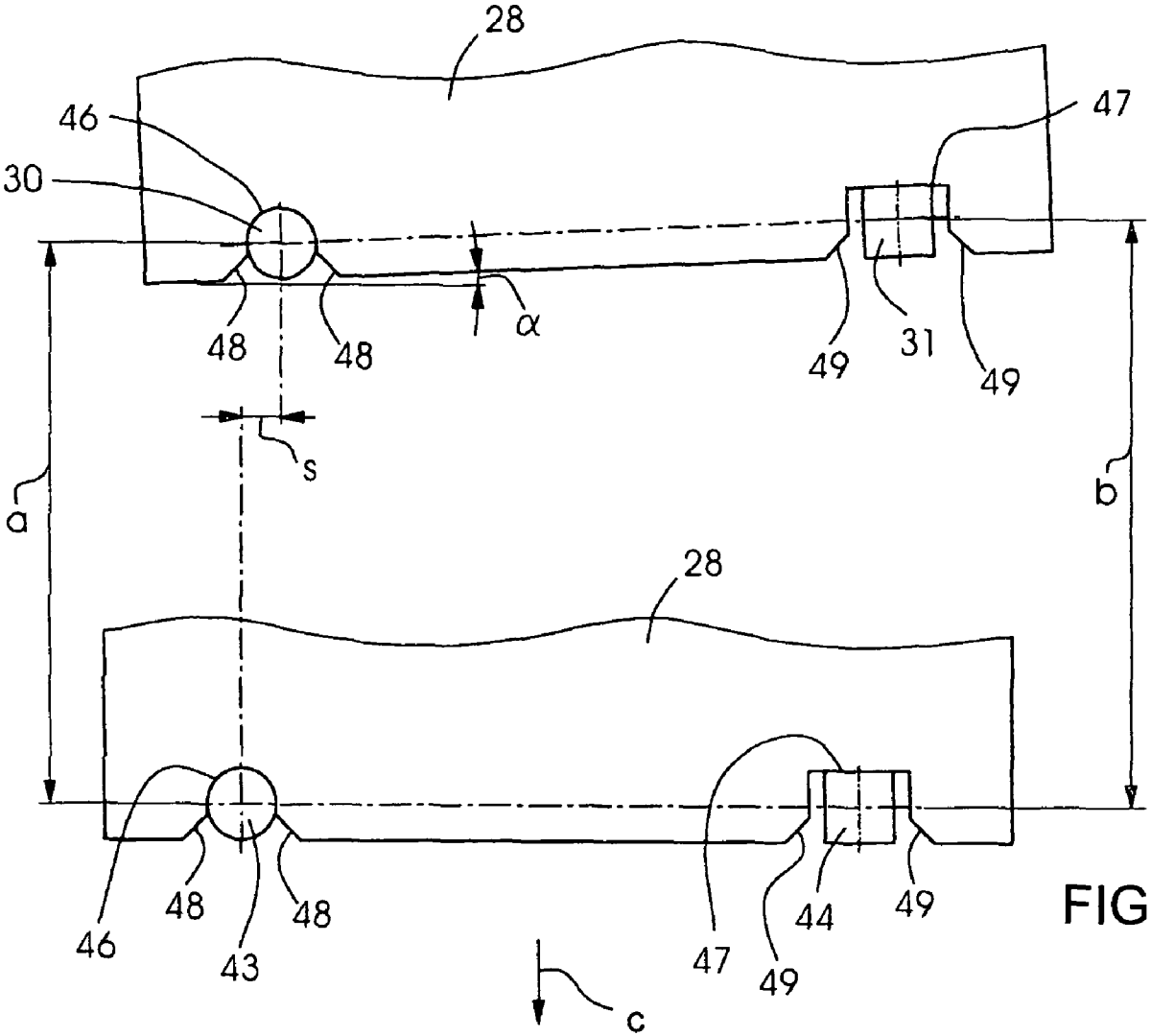
FIG. 4 is a diagrammatic plan view of the printing plate feed path with prealignment and final alignment.

At its front edge, the printing plate has two receptacles 46, 47 which, for prealignment, are first of all brought into bearing contact with the stops 30, 31 of the printing plate feed apparatus (in the direction of arrow C in FIG. 4) and later with the register pins 43, 44 on the plate cylinder 11.

The stop 30 and the register pin 43 have a circular cross section and, for example as viewed in the printing plate feed direction, are arranged on the right hand side of the printing plate.

The receptacle 46 which can be brought into contact with said aligning means 30, 43 likewise has a contour which is adapted to the circular shape, run up slopes 48 being provided which are arranged in a funnel shape and facilitate the engagement of the register pin 43 into the receptacle 46.

The stop 31 and the register pin 43 have a square or rectangular cross section and, as viewed in the printing plate feed direction, are correspondingly arranged on the left hand side of the printing plate.

The receptacle 47 which can be brought into contact with said aligning means 31, 44 likewise has a contour which is adapted to the cross sectional shape, with run up slopes 49 which are arranged in a funnel shape.

When the printing plate 28 is fed to the plate cylinder 11, said printing plate 28 is first of all prealigned on the stops 30, 31. Here, the printing plate 28 assumes an oblique position in relation to its aligned position on the plate cylinder and is arranged to the side by the offset S in the printing plate feed direction, for example to the left.

The printing plate is then fed in this position to the register pins 43, 44 of the plate cylinder 11. Here, the printing plate 28 first of all comes into contact by way of the run up slope 48 of the receptacle 46 with the circular register pin 43.

As a result of the run up slope 48, the printing plate is displaced laterally to the right, as viewed in the printing plate feed direction, until the register pin 43 engages into the circular receptacle 46. The printing plate is then pivoted about the register pin 43 until the register pin 44 also engages into the receptacle 47. The printing plate is then aligned on the plate cylinder with regard to the register pins 43, 44 and can be clamped by means of the provided clamping elements 13.

After the printing plate 28 has been gripped and clamped fixedly, the lever 37 is pivoted away with the printing plate flexing roller 41, the guide plane 32 and the transport roller 36.

As a result of this measure, the printing plate 28 can be wound up by rotation of the plate cylinder 11, without the guide elements being in contact with the imaged side of the printing plate 28.

The printing plate is fed by means of the transport rollers 34, 36 and the pivoting movements of the guide element 27 and the lever 37 take place by way of actuating means which can be actuated remotely, preferably in an automatically controlled manner.

The invention claimed is:

1. A method for feeding a printing plate to a plate cylinder of a processing machine, the method which comprises:

pre-aligning the printing plate on stops outside the plate cylinder in an obliquely and laterally offset position relative to a final alignment position, the stops engaging corresponding receptacles formed in a front edge of the printing plate;

subsequently feeding the printing plate in the obliquely and laterally offset position to register devices of the plate cylinder; and aligning the printing plate laterally upon a first one of the receptacles coming into contact with a first register device and pivoting the printing plate about the first register device until the printing plate is aligned in the final alignment position with a second register device engaged with a second one of the receptacles.

2. The method according to claim 1, wherein the processing machine is a printing press.

3. The method according to claim 1, which comprises first bringing the first receptacle of the printing plate into engagement with the first register device and subsequently bringing the second receptacle of the printing plate into contact with the second register device by pivoting the printing plate about the first register device.

4. A system for feeding printing plates to a plate cylinder of a processing machine, comprising:

a printing plate having a front edge with a first and second receptacle formed therein;

an aligning assembly formed with an aligning device for a prealignment of the printing plate and an aligning device for a final alignment of the printing plate;

said aligning device for the prealignment of the printing plate having a lateral offset with respect to said aligning device for the final alignment of the printing plate on the plate cylinder;

said aligning device for the prealignment of the printing plate having a first stop for engaging said first receptacle and a second stop for engaging said second receptacle and said aligning device for the final alignment of the printing plate having a first register pin for engaging said first receptacle and a second register pin for engaging said second receptacle; and a spacing between said first stop and said first register pin being greater than a spacing between said second stop and said second register pin.

5. The system according to claim 4, wherein the processing machine is a printing press.

6. The system according to claim 5, wherein said stops for the prealignment of the printing plate are disposed on a protective device covering a cylinder and roll region of said printing press.

7. The system according to claim 4, which comprises transport means for transporting the printing plate from said first and second stops to said first and second register pins.

8. The system according to claim 4, wherein said stops for the prealignment of the printing plate are disposed on a protective device of the processing machine.

9. The system according to claim 4, wherein said first and second register pins are disposed on the plate cylinder.

10. A rotary printing press, comprising the system according to claim 4.

11. An apparatus for feeding a printing plate to a plate cylinder of a processing machine, comprising:

an aligning assembly formed with an aligning device for a prealignment of the printing plate and an aligning device for a final alignment of the printing plate;

said aligning device for the prealignment of the printing plate having a first stop and a second stop;

said aligning device for the final alignment of the printing plate having a first register pin and a second register pin, said first register pin and said second register pin each being respectively laterally offset by a same distance in a same direction relative to said first stop and said second stop; and a spacing between said first stop and said first register pin being greater than a spacing between said second stop and said second register pin.

* * * * *